US006341476B2

(12) United States Patent
Golightly

(10) Patent No.: US 6,341,476 B2
(45) Date of Patent: Jan. 29, 2002

(54) APPARATUS FOR BUNDLING LAYERED MATERIAL

(75) Inventor: Ralph Wayne Golightly, Gadsden, AL (US)

(73) Assignee: The Goodyear Tire & Rubber Company, Akron, OH (US)

( * ) Notice: Subject to any disclaimer, the term of this patent is extended or adjusted under 35 U.S.C. 154(b) by 0 days.

(21) Appl. No.: 09/795,074

(22) Filed: Feb. 26, 2001

Related U.S. Application Data

(63) Continuation of application No. PCT/US98/23106, filed on Oct. 30, 1998, now abandoned.

(51) Int. Cl.[7] ..... B65B 13/02

(52) U.S. Cl. ..... 53/582; 53/528; 100/12; 100/33 R

(58) Field of Search ..... 100/3, 1.2, 30, 100/33 R; 53/528, 138.2, 582

(56) References Cited

U.S. PATENT DOCUMENTS

| | | | | |
|---|---|---|---|---|
| 2,386,153 A | * | 10/1945 | Watt et al. | 100/30 X |
| 3,447,447 A | * | 6/1969 | Rutty | 100/30 X |
| 3,768,397 A | | 10/1973 | Plattner | |
| 5,141,033 A | | 8/1992 | Rausch | |
| 5,560,187 A | | 10/1996 | Nagashima et al. | |

FOREIGN PATENT DOCUMENTS

| | | |
|---|---|---|
| EP | 0320221 | 6/1989 |

* cited by examiner

*Primary Examiner*—Stephen F. Gerrity
(74) *Attorney, Agent, or Firm*—David E Wheeler

(57) ABSTRACT

A method and apparatus for bundling layered material comprises an anvil for receiving multiple units of bundled material, and a plurality of blades for compressing a tying material onto the bundled material. An apparatus of the invention is illustrated for use in a specific method of simultaneously stapling the end wire of a plurality of tire beads.

6 Claims, 7 Drawing Sheets

APPARATUS FOR BUNDLING LAYERED MATERIAL

This application is a continuation of international application No. PCT US98 23106, filed Oct. 30, 1998 now abandoned.

TECHNICAL FIELD

The invention relates to an apparatus and method for bundling layered material. In a specific application, the invention may be used to staple the end wire in the bead of a pneumatic tire.

BACKGROUND ART

When a wire wound tire bead is made, the turn of wire that is wound last, or the end wire, is loose, and is not supported by the bead, or by any other means. Because of spring in the wire, the end wire tends to straighten and separate itself from the annular configuration of the bead, or tends to move laterally away from the bundle in the curing process. In order to prevent non-uniformities in the tire, or damage to the tire caused by the loose end wire, prior art beads are wrapped with tape, wire, synthetic cord, or stapled to hold the end wire tight to the annular configuration of the bead. This step in bead construction consumes material and labor, is labor intensive in the cases where the bead is wrapped.

Applicant is aware that stapled tire beads are in the art or are described in the art, but applicant has no knowledge of the apparatus or the methods used to prepare such prior art beads.

It is an object of the invention to provide apparatus and a method of reducing material consumption and reduce the labor involved in building beads for pneumatic tires. Other objects of the invention will be apparent from the following description and claims.

DISCLOSURE OF INVENTION

An apparatus for bundling of multi-layered material comprises (a) an anvil with a specific shape for containing multi-layered material in a specific configuration, (b) tying means for tying the multi-layered material in a bundle, the tying means being stored on the apparatus in proximity to the anvil, (c) at least one blade in the proximity of the anvil, the at least one blade having a specific shape that together with the shape of the anvil accommodates the shape of the bundle, the at least one blade and the anvil being movable relative to one another, wherein the tying means is disposed between the at least one blade and the anvil, and (d) means for activating the apparatus such that the anvil and at least one blade come together to confine the multi-layered material, while the tying means is simultaneously pressed between the anvil and the at least one blade and around the layered material.

In the illustrated embodiment, the movements of the apparatus are controlled by pneumatic logic. The movements of the apparatus may also be controlled by a computer.

The multi-layered material may be loaded on the apparatus and bundled material may be removed from the apparatus manually or by using automated equipment.

The anvil has a plurality of trough shaped areas for containing the multi-layered material, each of the trough shaped areas comprising an arc shape, having a diameter of 0.3 to 0.8 inches, which are adapted to be used in conjunction with a blade having a notched end, each notched end having an arc shape and a diameter of 0.1 to 0.8 inches. The means for activating the apparatus is a pneumatic cylinder which provides compressed air for moving the anvil and the blades into proximity to one another, and for compressing the tying means onto the multi-layered material.

In the illustrated embodiment, the tying means is a horseshoe shaped wire staple. The staples are contained on the apparatus in a guide under constant tension, whereby when a blade is withdrawn from the proximity of the anvil and past the staples, the tension causes a staple to move between the blade and the anvil. The tension is provided by free weights attached to a cable, the cable being strung through a center of a plurality of staples and attached to a stop contact adjacent the last staple in the guide.

A guide bar is provided above the staples to partially control the movement of a staple into position between the anvil and the blade.

More specifically, the illustrated apparatus is used for stapling tire beads and comprises (a) an anvil for receiving a plurality of beads, (b) a plurality of blades in the proximity of the anvil, the anvil and plurality of blades being movable relative to one another, (c) tying means disposed between the anvil and the plurality of blades, and (d) means for activating the apparatus such that the anvil and plurality of blades come together to confine a plurality of tire beads in a specific configuration, while the tying means is simultaneously pressed between the anvil and the plurality of blades and around the beads.

DETAILED DESCRIPTION OF THE INVENTION

Figure 1:
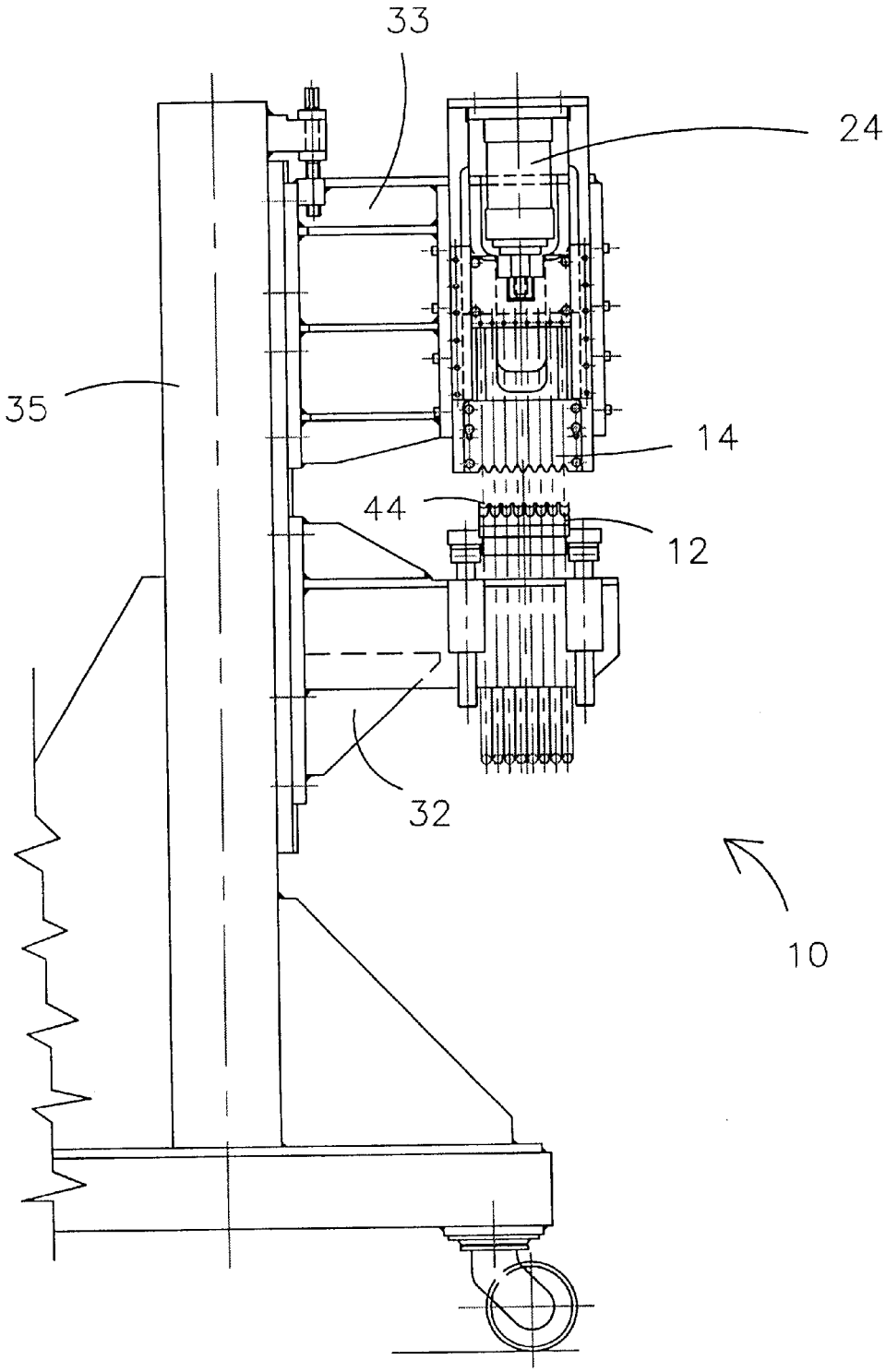
FIG. 1 illustrates a left side view of the apparatus of the invention.
Figure 2:
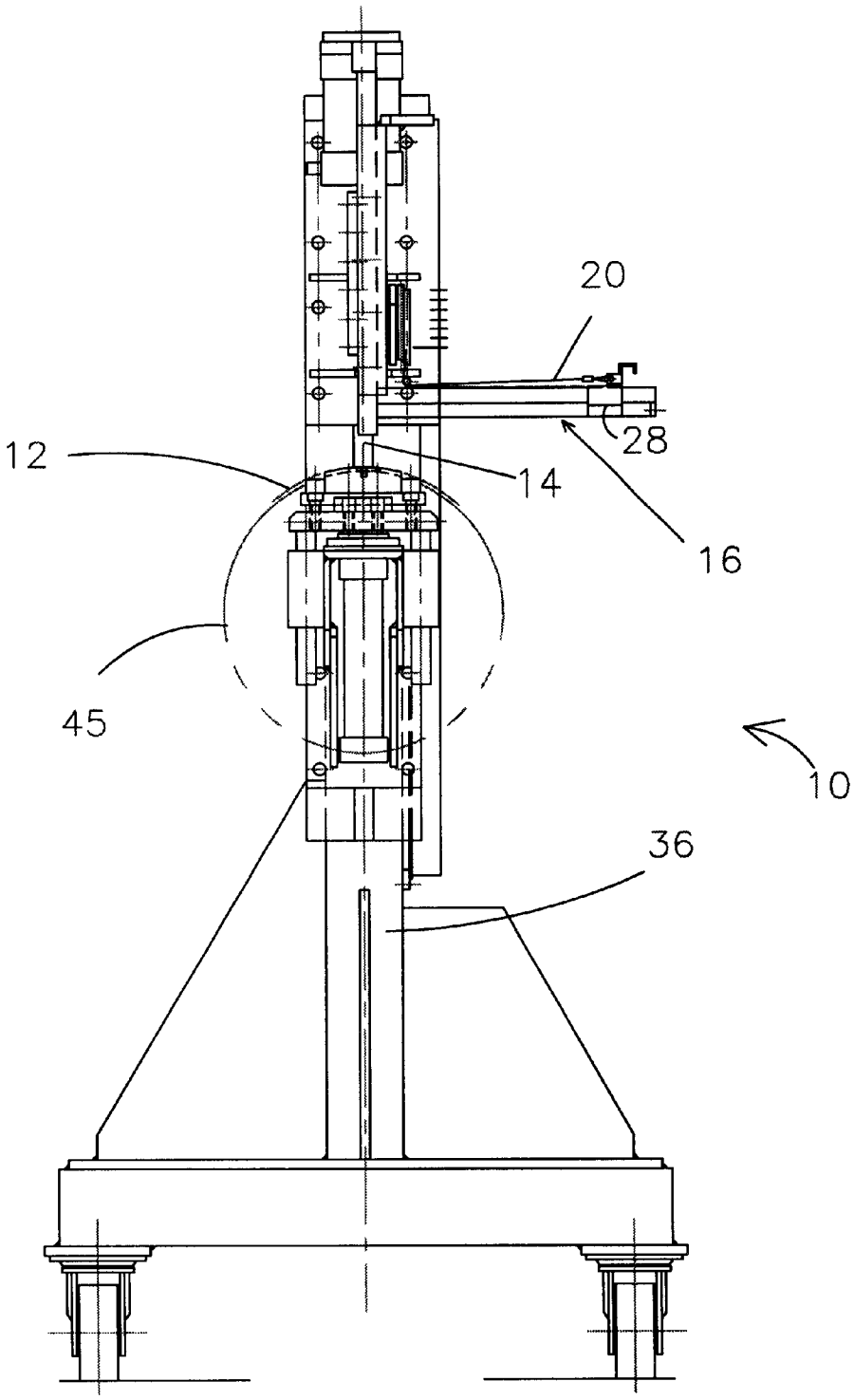
FIG. 2 illustrates a front view of the apparatus in an open position.
Figure 3:
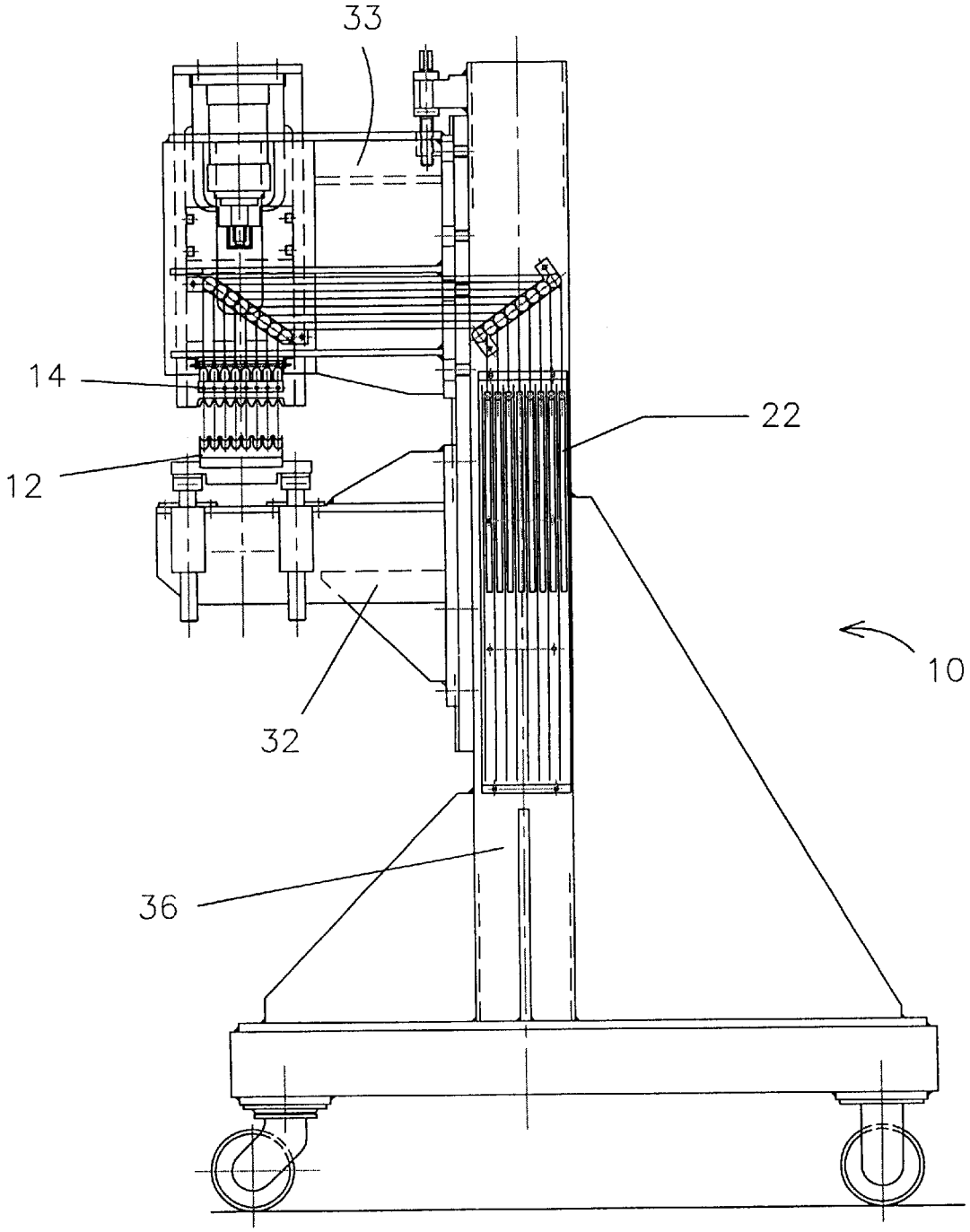
FIG. 3 illustrates a right side view of the apparatus in an open position.

With reference now to FIGS. 1, 2 and 3, the left side, front, and right side of the apparatus (10) respectively are illustrated. The view illustrated in FIG. 2 is designated as the front side since this will be the view seen by the operator when the apparatus is operated manually.

The apparatus (10) comprises an anvil (12) which has a plurality of receiving areas (44) for receiving a layered material therein. The apparatus of the invention is particularly useful for handling bulk materials and confining said materials into a package having a particular shape or orientation. In the illustrated embodiment, anvil (12) has 8 receiving areas (44) which are shaped to receive a tire bead and are substantially rounded. Those skilled in the art will recognize that any convenient number of receiving areas (44) may be used in an anvil (12) of the apparatus and that any shape receiving area can be used, and the shape of the receiving area may be dictated by the nature of the layered material which is to be placed in the receiving area to be bundled.

The anvil (12) is connected to the apparatus (10) through support (32) which is attached to the base (36) of apparatus (10). In close association with anvil (12) on the apparatus are blades (14). Blades (14) are attached to support (33) which is attached to base (36) of the apparatus (10). Either or both of support (32) and (33) may be slideable on base (36) so that the gap between blades (14) and anvil (12) may be opened and closed as the apparatus is operated.

The movement of either support (33) or (32) or both on base (36) is initiated by pneumatic forces. The machine may be equipped with pneumatic control, or the pneumatic forces may be controlled by a computer.

Figure 8:
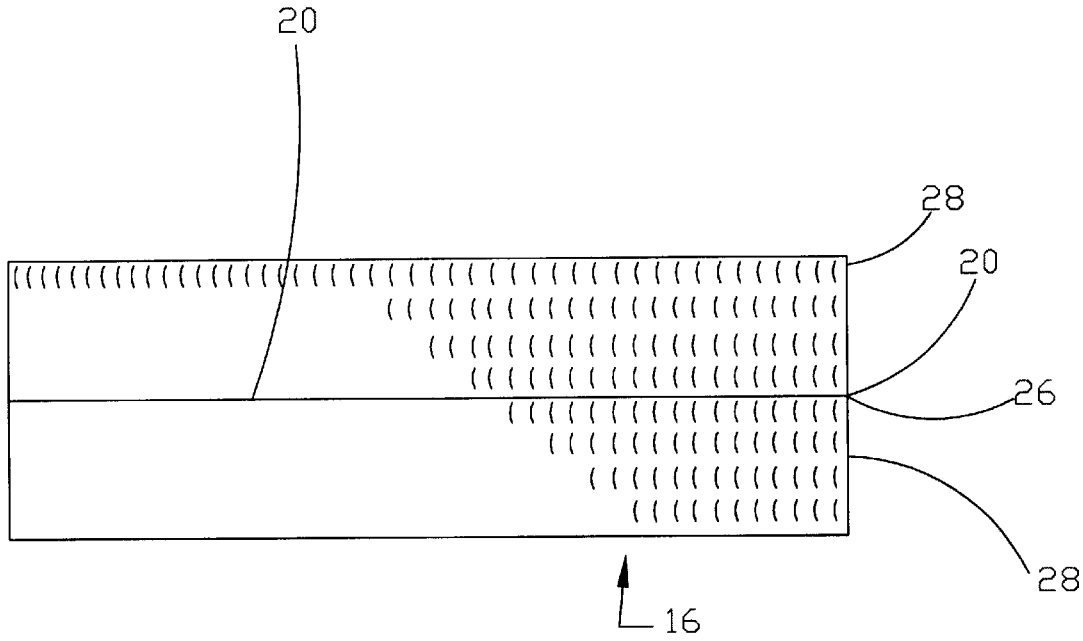
FIG. 8 illustrates a top view of a guide for holding staples in the apparatus of the invention.

With reference specifically to FIG. 2 and FIG. 8, a guide (16) may be associated with the apparatus for containing tying means which are used to tie together the layers of material that are placed in the apparatus. In the illustrated embodiment, the tying means are horseshoe shaped staples (18) (see FIG. 6). Cable (20) is attached to a sheet metal bar (28), at center (26), at the end of the rows of staples in the guide (16), and is also attached to weights (22) (see FIG. 3) which provide a constant tension on the staples (18) in the guide (16). Sheet metal bar (28) applies a substantially even pressure to each of the rows of staples and helps assure that a staple is locked in each row when the apparatus is activated.

In the operation of apparatus (10), air cylinder (24) provides a pneumatic force for bringing blades (14) together with anvil (12), whereby bundled material placed in the receiving areas (44) of anvil (12) is pressed between anvil (12) and blades (14). One set of staples (18) are positioned between anvil (12) and blades (14), and when the anvil (12) and blades (14) are brought together, are trapped between anvil (12) and blades (14), and forced around the bundled material in the shape of receiving means (44) in anvil (12). After the bundled material is tied together by compression of blades (14) on anvil (12), the machine is activated to separate or open the gap between anvil (12) and blades (14). As blades (14) are raised above the level of staple guide (16), the tension from weights (22) applied to cable (20) forces another set of staples into position between anvil (12) and blades (14).

To control the rows of staples (18) in the guide (16), i.e., to prevent the rising up of staples (18) as they are pushed forward, a 0.5 to 0.75 inch sheet metal guide (not shown) is provided above the staples to prevent their rising out of alignment at the point where the staples are loaded for compression between blades (14) and anvil (12).

Figure 7:
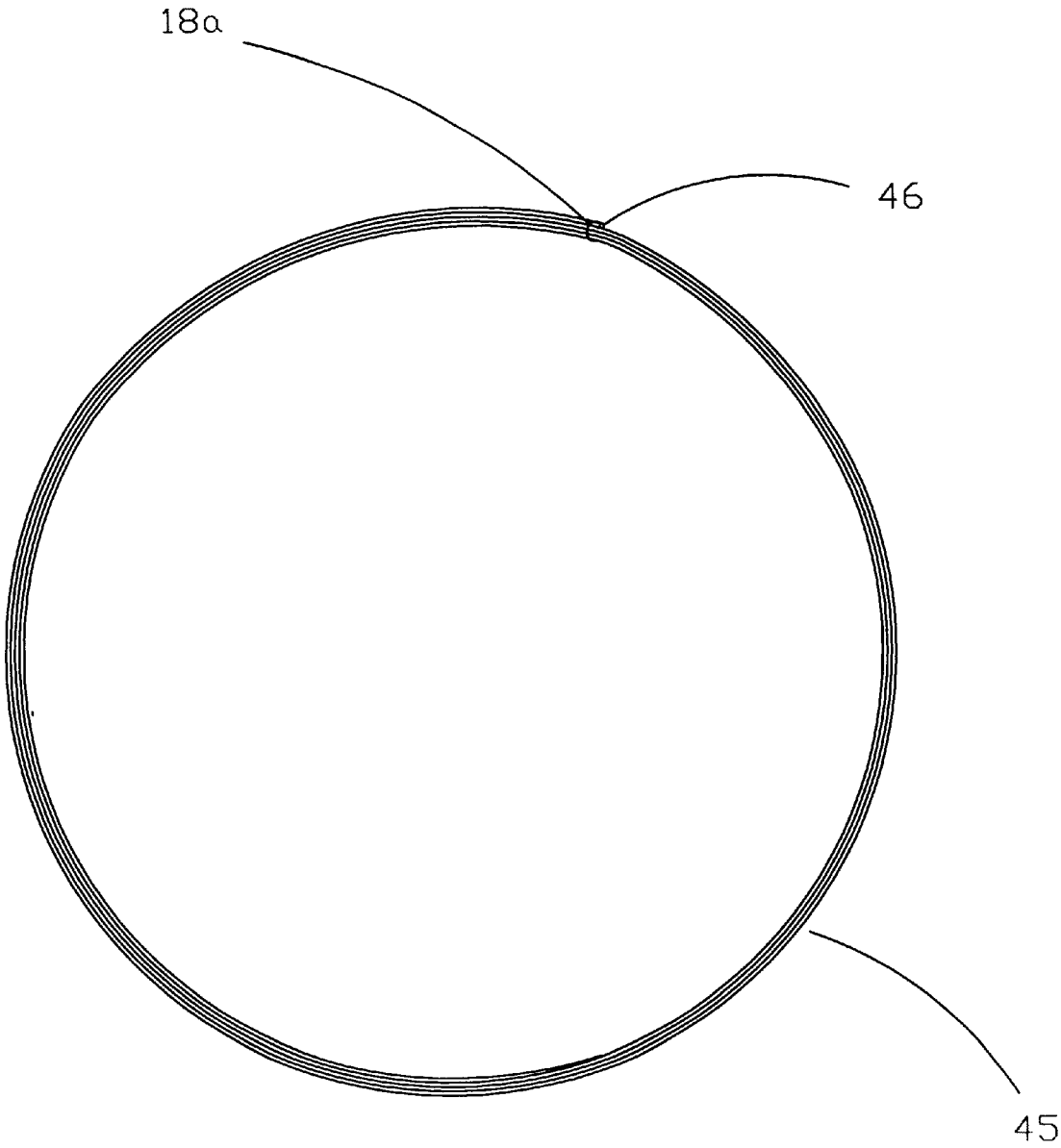
FIG. 7 illustrates a stapled tire bead.

In the operation of the apparatus of the illustrated embodiment, a plurality of tire beads (45), which may be simultaneously manufactured are placed on anvil (12) and are spaced so that one tire bead occupies each receiving area (44) of anvil (12). The beads are oriented so that the end wire (46) (see FIG. 7) is aligned with blades (14). When the apparatus is activated so that anvil (12) and blades (14) come together, blades (14) push a set of staples (18) downward toward anvil (12), wherein continued closing of the gap between blades (14) and anvil (12) force the staples to bend around receiving area (44) and to compress on to the beads.

Figure 4:
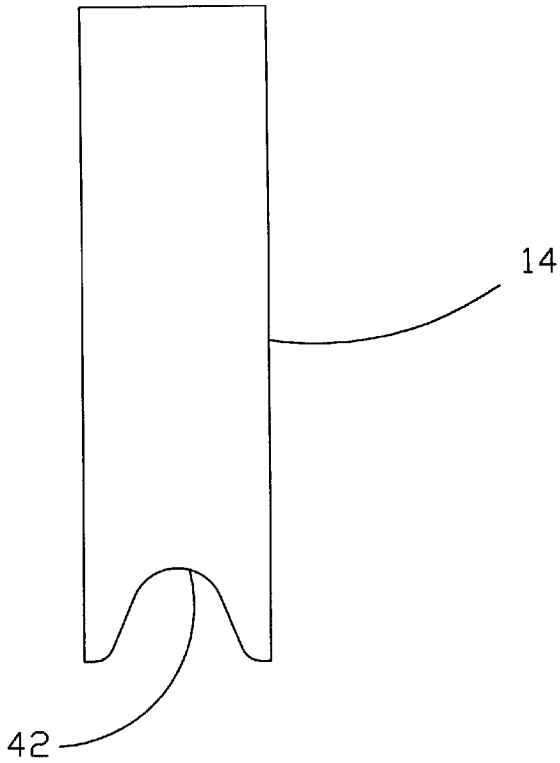
FIG. 4 illustrates a single blade used in the apparatus.

With reference to FIG. 4, blades (14) are fabricated individually with an arced end (42) which is specifically adapted for the particular material which is being bundled. It has been found that different arcs (42) can be used in blade (14) for different sizes of tire beads, and that a small arc can be used on many different sizes of tire beads. The arc of the blade may be minimal and in one embodiment represents a radius of the "V" of an otherwise V-shaped end (42) of blade (14).

Those skilled in the art will recognize that blades (14) may be constructed in one unit having arcs (42) of sufficient number to match the plurality of receiving areas (44) in an anvil (12).

Figure 5:
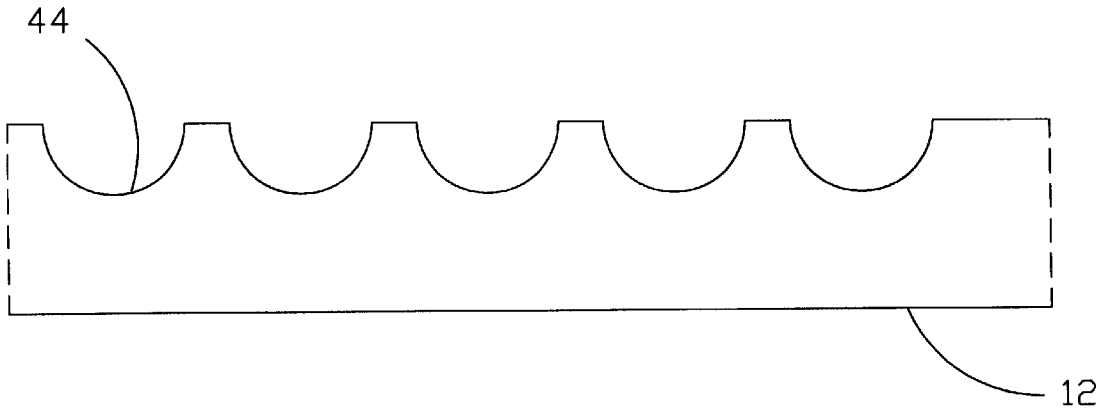
FIG. 5 illustrates an anvil with multiple arced positions for receiving layered material.

With reference to FIG. 5, anvil (12) may be made from a single block of material, preferably steel of sufficient width to accommodate the number of receiving areas (44) desired. Although the illustrated apparatus has 8 such receiving areas, the anvil (12) may be made with any convenient number of receiving areas (44).

Figures 6, 6A:
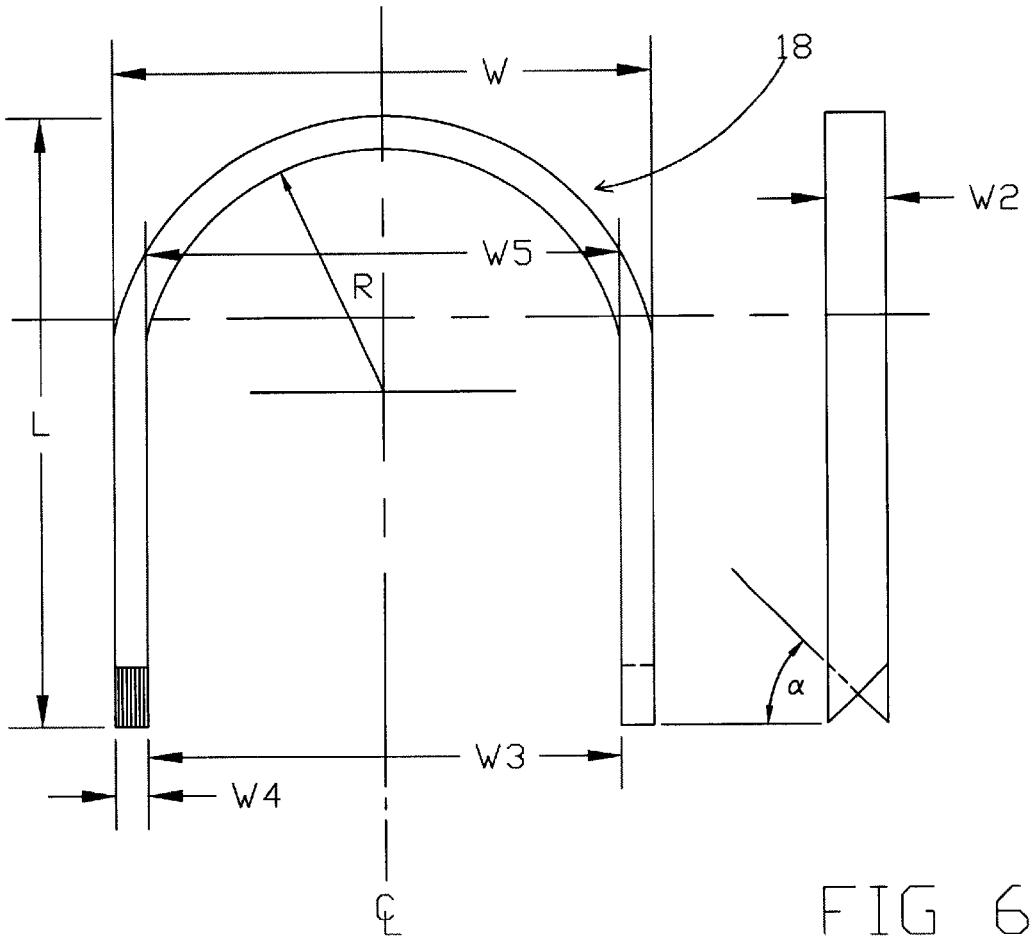
FIGS. 6 and 6*a* illustrate a horseshoe shaped staple used in the apparatus of the invention.

Staples (18) are made of conventional staple wires that are contoured to have a horseshoe shape (see FIG. 6). The horseshoe shape of staple (18) facilitates the shaping of the staple between the arced end (42) of blade (14) and receiving area (44) of anvil (12). When staples having a conventional squared shape are used, there is a tendency for the apparatus to crush the top of the staple and kink the legs at the angle of the bend. The horseshoe shape reduces the fatigue exposure of the staple.

In the illustrated embodiment, staple (18) has a length (l) of about 0.6 inch, (l) being the distance from leg end (62) to a line (t) tangent to the top arch (64). The width (w) of staple (18) is about 0.5 inch. The width ($w_3$) between the legs (66) of staple (18) is about 0.45 inch and ($w_3$) may be slightly more than or slightly less than ($w_5$), which is the width of the arch (64). Arch (64) has a radius (R) of about 0.23 inch.

The staples are made from flat wire and have a width ($w_4$) of about 0.03 inch and width ($w_2$) of about 0.06 inch. The leg ends (62) may be cut on an angle and may have an angle $\alpha$ of about 45° with a plane containing both leg ends (62) of a staple (18).

The apparatus may be operated manually whereby the operator places a plurality of tire beads on anvil (12) in the proper position, then activates the apparatus by pressing safety switches, one with each hand, so that the hands are clear of the closing blades (14) and anvil (12). When the bundled material is tied together by the staples, and the gap between blades (14) and anvil (12) opens, the operator removes the completed material and prepares the apparatus for the next operation.

Those skilled in the art will recognize that this procedure may be automated, for example by the use of a robot, or robotic attachments to the apparatus.

When pneumatic control is used in the apparatus, a series of pneumatic stops are used wherein the movement of the apparatus provides activation required for each subsequent movement of the apparatus. Similarly, when computer control of the apparatus is used, electronic sensors are provided on the apparatus which provide information to the computer as to the position of each of the moving parts of the apparatus, and the software of the computer is used to activate the apparatus at each position. Such machine controls are well known to those skilled in the art.

While the invention has been variously illustrated and described, those skilled in the art will recognize that the invention may be variously modified and practiced without departing from the spirit of the invention. The scope of the invention is limited only by the following claims.

What is claimed is:

1. An apparatus for bundling of multi-layered material, said apparatis comprising:

(a) an anvil with a specific shape for containing multi-layered material in a specific configuration, (b) tying means for tying said multi-layered material in a bundle, said tying means being stored on the apparatus in proximity to said anvil, (c) at least one blade in the proximity of said anvil, said at least one blade having a specific shape that together with the shape of the anvil accommodates the shape of said bundle, said at least one blade and said anvil being movable relative to one another, wherein said typing means is disposed between said at least one blade and said anvil, and (d) means for activating said apparatus such that the anvil and at least one blade come together to confine the multi-layered material, while said typing means is simultaneously pressed between said anvil and said at least one blade and around said layered material characterized in that said anvil has a plurality of trough shaped areas for containing said multi-layered material, each said area comprising an arced shape having a diameter of 0.762 to 2.03 cm (0.3 to 0.8 inch), which are adapted to be used in conjunction with said at least one blade, said at least one blade having a notched end, said notched end having an arced shape and a diameter of 0.254 to 2.03 cm (0.1 to 0.8 inch).

2. The apparatus of claim 1 characterized in that said tying means is a horseshoe shaped wire staple.

3. The apparatus of claim 1 characterized in that staples are contained on said apparatus in a guide under constant tension, whereby when a blade is withdrawn from the proximity of the anvil and past the staples, said tension causes a staple to move between the blade and said anvil.

4. The apparatus of claim 3 characterized in that said tension is provided by free weights attached to a cable, said cable being strung through a center of a plurality of staples and attached to a stop contact adjacent the last staple in said guide.

5. The apparatus of claim 3 characterized in that a guide bar is provided above said staples to partially control the movement of a staple into position between said anvil and said blade.

6. The apparatus of claim 1 characterized in that the means for activating said apparatus is a pneumatic cylinder which provides compressed air for moving said anvil and said blades into proximity to one another and for compressing said tying means onto said multi-layered material.

* * * * *